US007032300B2

(12) United States Patent
Suzuki

(10) Patent No.: US 7,032,300 B2
(45) Date of Patent: Apr. 25, 2006

(54) WIRE INSULATION DISPLACEMENT CONNECTION APPARATUS WITH PITCH CONVERSION MECHANISM

(75) Inventor: Satoshi Suzuki, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 390 days.

(21) Appl. No.: 10/226,806

(22) Filed: Aug. 23, 2002

(65) Prior Publication Data

US 2003/0045157 A1 Mar. 6, 2003

(30) Foreign Application Priority Data

Aug. 30, 2001 (JP) ..... 2001-261534

(51) Int. Cl.
*H01R 43/00* (2006.01)

(52) U.S. Cl. ..... 29/749; 29/748; 29/33 F; 29/33 M; 29/564.4; 29/825; 29/857; 29/861

(58) Field of Classification Search ..... 29/857, 29/861, 825, 863, 749, 748, 33 F, 33 M, 29/564.4

See application file for complete search history.

(56) References Cited

U.S. PATENT DOCUMENTS 4,433,479 A * 2/1984 Suzuki et al. ..... 29/825

FOREIGN PATENT DOCUMENTS

| | | |
|---|---|---|
| JP | 62-168356 | 1/1986 |
| JP | 2967081 | 6/1998 |

* cited by examiner

*Primary Examiner*—Richard Chang
(74) *Attorney, Agent, or Firm*—Barley Snyder LLC

(57) ABSTRACT

Wire insulation displacement connection apparatus including a wire supply portion, a first press-contacting portion arranged downstream from the wire supply portion, and a second press-contacting portion arranged downstream of the first press-containing portion. A pitch converting comb blade is arranged between the second press-contacting portion and a measuring clamp, which pulls out a first connector press-contacted to front tips of the wires. The pitch converting comb blade has pitch conversion grooves which increase the spacing between the wires. The comb blade is arranged such that the pitch of the wires in the region of the second press-contacting portion, where a second connector is press-contacted to the wires, is the same as the pitch of the terminals of the second connector.

21 Claims, 8 Drawing Sheets

WIRE INSULATION DISPLACEMENT CONNECTION APPARATUS WITH PITCH CONVERSION MECHANISM

FIELD OF THE INVENTION

The present invention relates generally to a wire insulation displacement connection apparatus for press-contacting a plurality of wires to terminals of a connector. More particularly, the present invention relates to a wire insulation displacement connection apparatus with a pitch conversion mechanism for press-contacting wires to connectors at both ends of the wires, each of which has terminals arranged at a different pitch.

BACKGROUND OF THE INVENTION

A wire insulation displacement connection apparatus having a pitch conversion mechanism for a connector is described in Japanese Unexamined Patent Publication No. 62 (1987)-168356. The wire insulation displacement connection apparatus comprises a first press-contacting portion at an upstream position, and a second press-contacting portion at a downstream position. Aligning blades, which act as pitch conversion mechanisms for wires supplied in an array, are positioned upstream from the first press-contacting portion and downstream from the second press-contacting portion. Each of the aligning blades requires a drive mechanism. In view of the use of these drive mechanism, the press-contacting apparatus is a complex unit and as a result, the cost of the apparatus is expensive and maintenance of the apparatus is difficult. Also, it is a disadvantage that the apparatus has a relatively large number of parts.

A wire insulation displacement connection apparatus for connectors with a different type of pitch conversion mechanism is described in Japanese Patent No. 2967081. The wire insulation displacement connection apparatus comprises two press-contacting punches. Templates, which act as pitch conversion mechanisms, are positioned on both sides (upstream and downstream) of the downstream press-contact punch. A plurality of these templates is assembled together, and the templates are attached to elevating units.

The number of parts in this apparatus is also relatively large. Therefore, the apparatus is complex, and there are problems in the maintenance of the apparatus. In addition, the degree of bend at the exit of the upstream press-contact punch is relatively large for the outer wires which have had their pitch converted. Therefore, it is a problem that the wires are prone to damage.

SUMMARY OF THE INVENTION

It is an object of the present invention to provide a wire insulation displacement connection apparatus with a pitch conversion mechanism having a simple, inexpensive structure, thereby making maintenance easy, and also while reducing the load on the wires thereby making the wires less prone to damage.

The wire insulation displacement connection apparatus with a pitch conversion mechanism according to the present invention is comprises a wire supply portion for supplying a plurality of wires, a first press-contacting portion for press-contacting the tips of the wires to a first connector at a first pitch, a clamp for grasping the first connector or the wires in the vicinity of the first connector and pulling the wires out towards the downstream side; a second press-contacting portion, positioned at a downstream side from the first press-contacting portion, for press-contacting the upstream side of the clamp of the wires which have been pulled out to a second connector at a second pitch and a pitch conversion mechanism for converting the pitch from the first pitch in order to press-contact the wires with the second press-contacting portion. The pitch conversion mechanism is arranged between the second press-contacting portion and the clamp, which has moved to the downstream side, and the pitch conversion mechanism converts the pitch of the plurality of wires to a third pitch such that the first pitch (P1), the second pitch (P2) and the third pitch (P3) satisfy the equation: $P3=d2(P2-P1)/d1+P1$, wherein d1 represents the distance between the first press-contacting portion and the second press-contacting portion, and d2 represents the distance between the first press-contacting portion and the pitch conversion mechanism.

Further, it is preferable that the second press-contacting portion has an applicator arranged to hold the second connector, and tapers are formed at the tip of the applicator for guiding the wires such that the wires align with terminals of the second connector.

The pitch conversion mechanism of the wire insulation displacement connection apparatus with a pitch conversion mechanism according to the present invention is arranged between the second press-contact portion and the clamp, which has moved to the downstream side, and converts the pitch of a plurality of wires to the third pitch. The first pitch (P1), the second pitch (P2), and the third pitch (P3) satisfy the following equation:

$P3=d2(P2-P1)/d1+P1$, wherein d1 represents the distance between the first press-contacting portion and the second press-contacting portion, and d2 represents the distance between the first press-contacting portion and the pitch conversion mechanism. Accordingly, it is not necessary to provide a pair of pitch conversion mechanisms. Therefore, the structure of the wire insulation displacement connection apparatus is simple and inexpensive, while maintenance of the apparatus is relatively easy. Further, a structure has been formed in which the pitch conversion mechanism is arranged only on one side of the second press-contacting portion. Therefore, for the wires on the side at which there is no pitch conversion mechanism, the pitch conversion is performed gradually over a long length of wire. Therefore, there are no sharp bends in the wires. Accordingly, the load on the wires at the bent portions is reduced, and the wires become less prone to damage.

Further, in an embodiment wherein the second press-contacting portion has an applicator arranged to hold the second connector, and tapers are formed at the tip of the applicator for guiding the wires such that the wires align with terminals of the second connector, the applicator may be inserted smoothly into the wire group without interfering with the wire group. This reduces the load on the wires during the press-contact procedure, and further reduces deficiencies in the press-contact procedure.

BRIEF DESCRIPTION OF THE DRAWINGS

The invention will now be described by way of example with reference to the accompanying figures of which:

FIGS. 9A, 9B, 9C and 9D show the second applicator, wherein FIG. 9A is a side view of the second applicator, FIG. 9B is a cross sectional view of the second application, FIG. 9C is a partial magnified side view of the comb blades of the second applicator, and FIG. 9D is a partial magnified front view of the comb blades of the second applicator.

DESCRIPTION OF THE PREFERRED EMBODIMENTS

Embodiments of the wire press-contact apparatus with pitch conversion mechanism according to the present invention will now be described in detail with reference to the attached drawings wherein the left side is designated as upstream, and the right side is designated as downstream.

Figure 1:
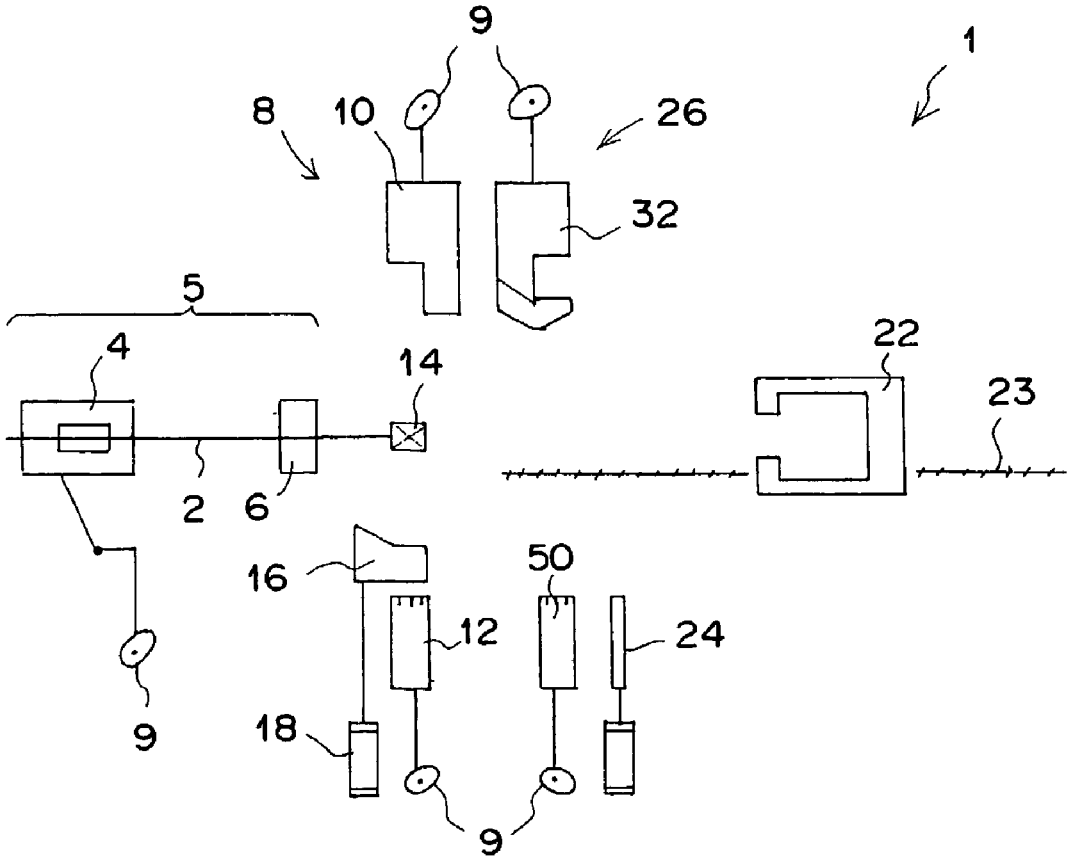
FIG. 1 is a schematic view of a wire insulation displacement connection apparatus according to the present invention after a first connector has been press-contacted.
Figure 8:
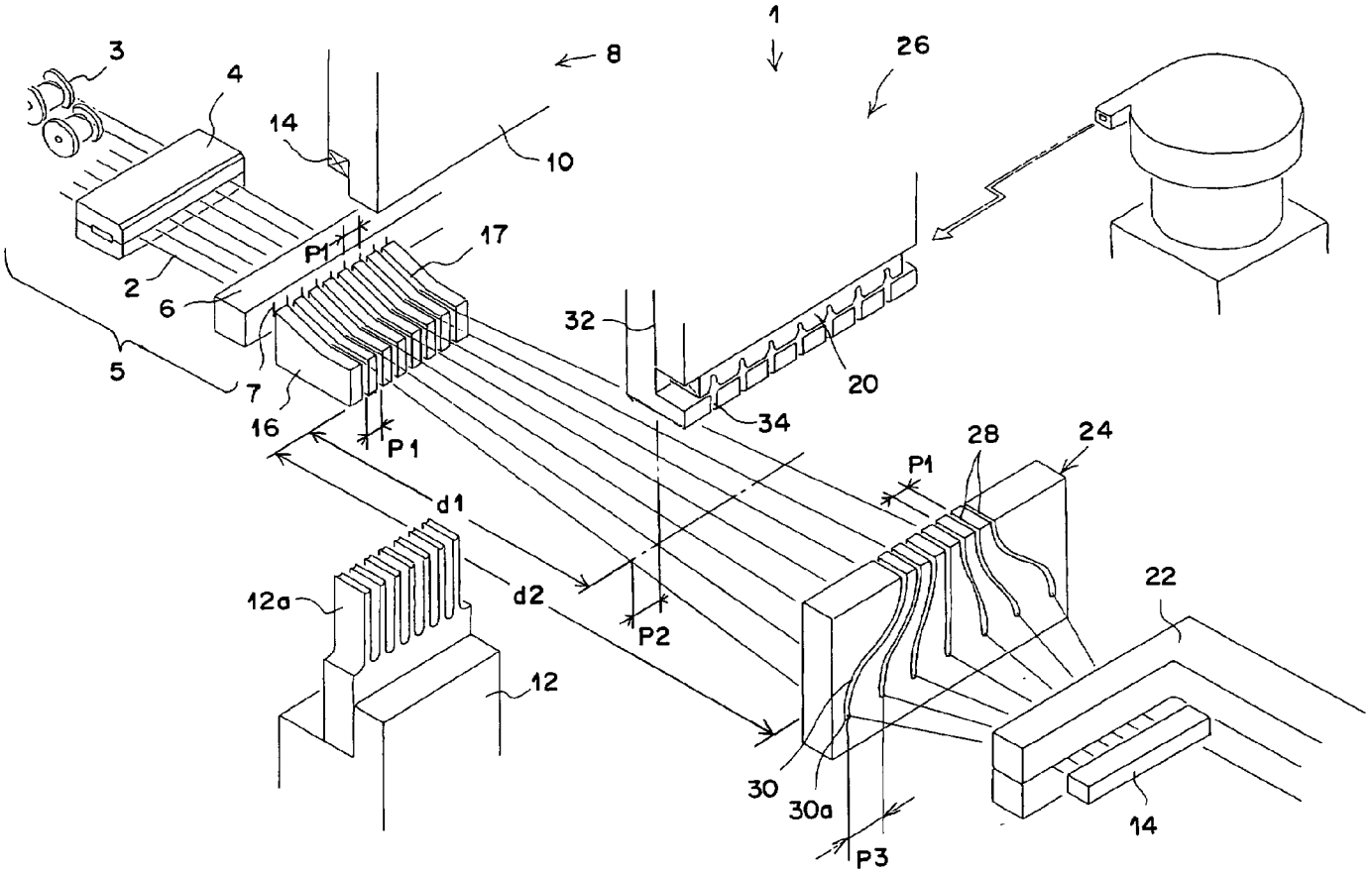
FIG. 8 is a schematic perspective view of the main parts of the press-contacting apparatus of the present invention.

Referring first to FIG. 1, a press-contacting apparatus 1 in accordance with the invention comprises a fixed wire guide 6 that acts as a guide member for aligning wires 2 at a first pitch P1, a first press-contacting portion 8 situated downstream from the fixed wire guide 6 and a second press-contacting portion 26 situated further downstream from the first press-contacting portion 8. The first press-contacting portion 8 comprises an applicator 10 and a stuffer 12. The second press-contacting portion 26 also comprises an applicator 32 and a stuffer 50. The wires 2 are supplied from a wire supply source 3 (as shown in FIG. 8) such as a reel or other suitable wire storage constructions. The wires 2 are supplied downstream along the wire path via a wire pullback clamp 4 and the fixed wire guide 6 situated downstream from the wire pullback clamp 4. The wire supply source 3, the wire pullback clamp 4 and the fixed wire guide 6 are collectively referred to as a wire supply portion 5. The fixed wire guide 6 has guide grooves 7 (as shown in FIG. 8) at a first pitch P1, i.e., at a first distance from one another. The applicator 10, the applicator 32, the stuffer 12, the stuffer 50, and the wire pullback clamp 4 are each driven separately by cams 9.

A first connector 14 at the tips of the wires 2 is press-contacted by the first press-contacting portion 8 of the press-contacting apparatus 1. The first press-contacting portion 8 press-contacts and connects the first connector 14 by means of the applicator 10 arranged above the wires 2 and the stuffer 12 arranged below the wires 2. More specifically, the applicator 10 holds the first connector 14 above the wires 2 while the stuffer 12 has a press-contact blade 12*a* whereby the applicator 10 and stuffer 12 approach each other with the wires 2 being situated between them. The press-contact blades 12*a* push the wires 2 into the terminals of the first connector 14 the thereby form a press-contact connection between the wires 2 and the first connector 14.

A movable wire guide 16 has guide grooves 17 at the first pitch P1 and is arranged on the same side of the wires 2 as the stuffer 12. The movable wire guide 16 is arranged to be insertable into the path of the wires 2 by a cylinder 18, which is operated by air pressure, hydraulic pressure or other suitable pressure providing fluids. The movable wire guide 16 performs positive positioning of the wires 2 when they are press-contacted to terminals (not shown) of the first connector 14. The press-contact blade 12*a* is inserted within the guide grooves 17 and press-contacts the wires 2 within the guide grooves 17 to the connector 14. The term "press-contact" refers to press-fitting wires 2 into wire receiving grooves of terminals (not shown) of the connector 14, tearing the insulative coatings of the wires 2 and electrically connecting the conductors (not shown) within the wires 2 to the terminals. The electrical connection procedure is well-known to those skilled in the art and therefore a detailed description of the electrical connection procedure is not provided herein.

Figure 2A:
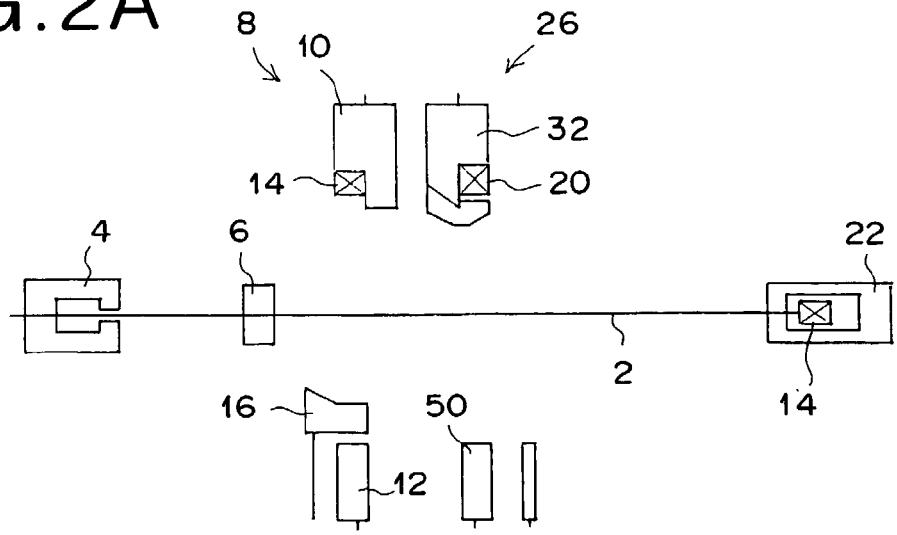
FIG. 2A is a schematic view of the wire insulation displacement connection apparatus according to the present invention showing the press-contacted first connector having been moved downstream by a clamp.
Figure 2B:
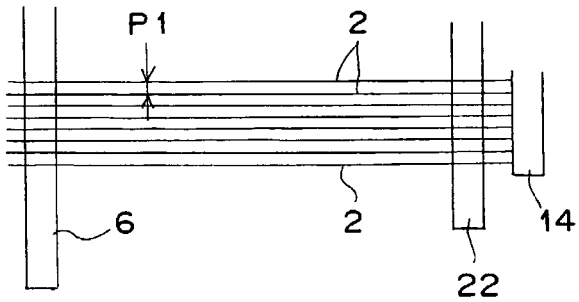
FIG. 2B is a schematic plan view of the wire insulation displacement connection apparatus showing the press-contacted first connector having been moved downstream by the clamp.

After the wires 2 are press-contacted and connected to the first connector 14, a measuring clamp 22 positioned downstream along the wire path is moved upstream by a moving means such as a bore screw 23. The measuring clamp 22 grasps the wires 2 in the vicinity of the first connector 14, and moves the first connector 14 downstream, as shown in FIG. 2A. At this time, the measuring clamp 22 measures the wires 2. The length of the wires 2 measured by the measuring clamp 22 ultimately becomes the length of a wire harness with connectors at both ends. At this time, the plurality of wires 2 are arranged parallel at intervals of the first pitch P1, as shown in FIG. 2B. In FIGS. 2A and 2B, the measuring clamp 22 is shown grasping the wires 2 in the vicinity of the first connector 14. However, a structure may be adopted wherein the measuring clamp 22 grasps the first connector 14 itself.

Figure 3A:
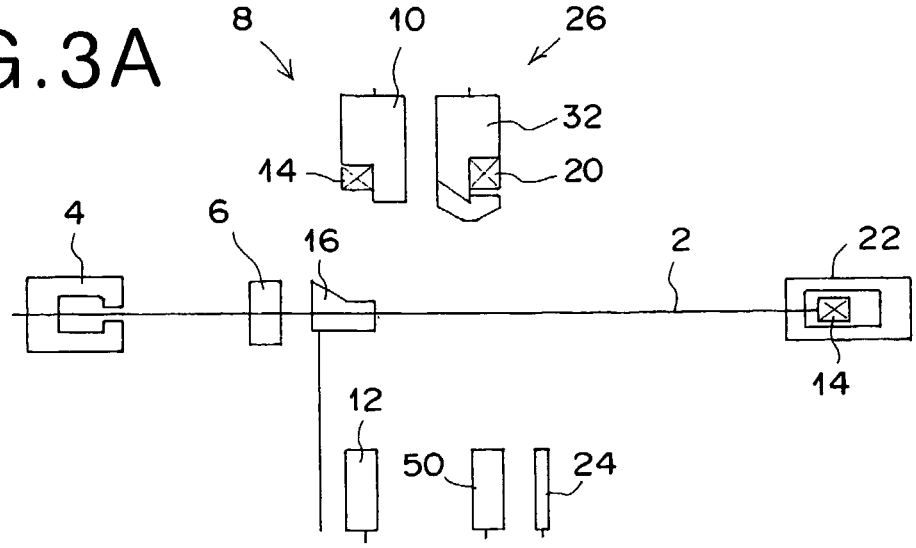
FIG. 3A is a schematic view of the wire insulation displacement connection apparatus showing a movable wire guide inserted into the wires.
Figure 3B:
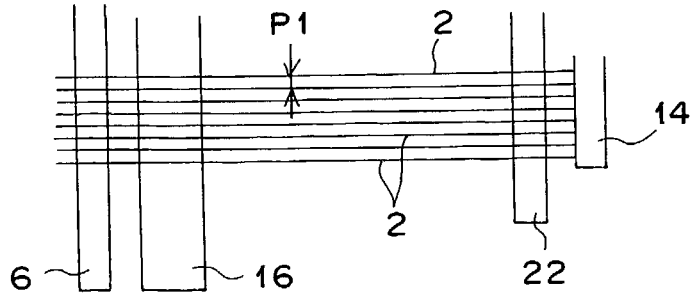
FIG. 3B is a schematic plan view of the wire insulation displacement connection apparatus in which the movable wire guide is inserted into the wires.

After the wires 2 have been pulled out a predetermined length as shown in FIGS. 2A and 2B, a second connector 20 is press-contacted on the upstream side of the wires 2. Prior to the press-contacting of the second connector 20, the movable wire guide 16 is inserted into the row of the wires 2 as shown in FIGS. 3A and 3B. The wires 2 are accurately maintained at the first pitch P1 as shown in FIG. 3B.

Figure 4A:
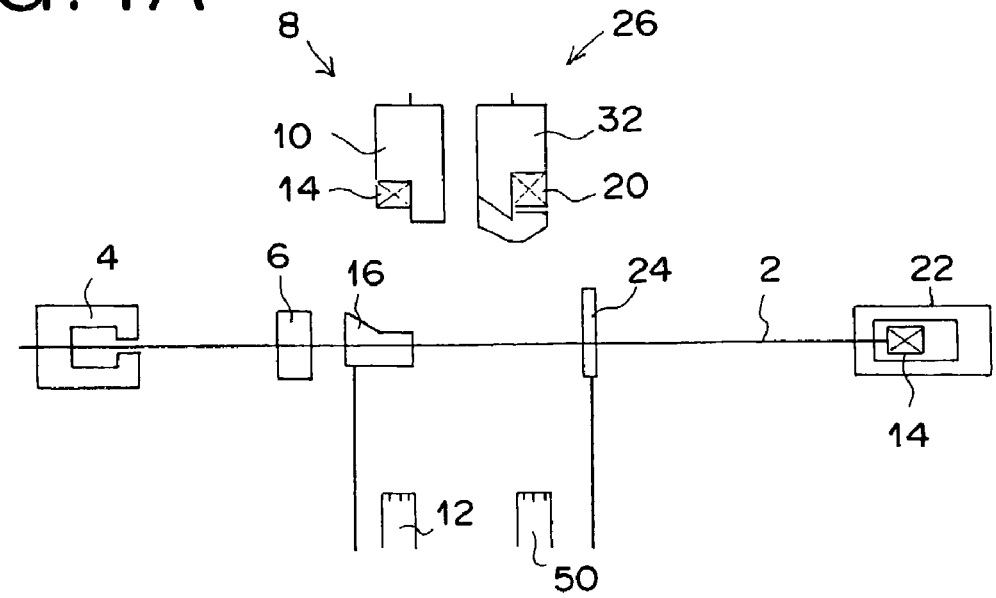
FIG. 4A is a schematic plan view of the wire insulation displacement connection apparatus showing a pitch conversion comb blade inserted into the wires.
Figure 4B:
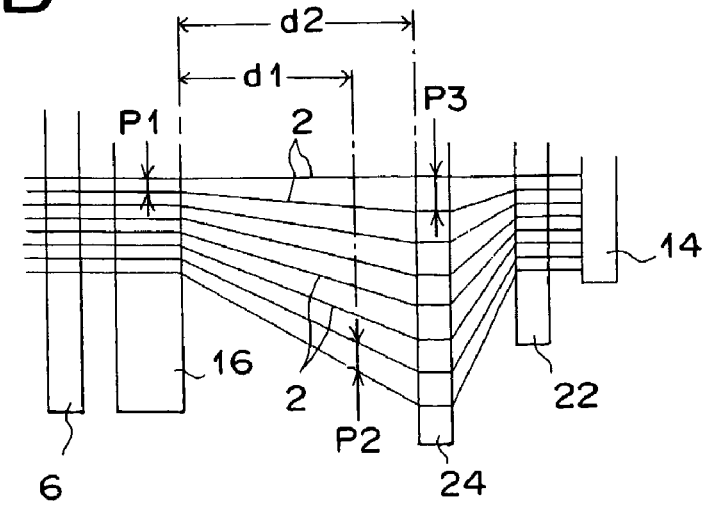
FIG. 4B is a schematic plan view of the wire insulation displacement connection apparatus showing the pitch of the wires when the pitch conversion comb blade is inserted into the wires.

Next, as shown in FIGS. 4A and 4B, a pitch converting comb blade (pitch conversion mechanism) 24, for converting the arrangement pitch of the wires 2, is inserted into the wires 2 downstream of the second press-contacting portion 26. The pitch converting comb blade 24 will be described in detail with reference to FIG. 8. The pitch converting comb blade 24 is formed as a rectangular plate which is substantially perpendicular to the wire path. A plurality of wire-receiving openings 28 arranged at the first pitch P1 are provided at the upper edge of the comb blade 24. The wire-receiving openings 28 extend downward and spread outward to thereby form pitch conversion grooves 30 which are open in the direction of the wire path. The intervals between the pitch conversion grooves 30 at their lower ends 30*a* are at a third pitch P3, which is wider than the first pitch P1.

Accordingly, the intervals between the wires 2 which are inserted into the wire receiving openings 28 widen as the pitch converting comb blade 24 rises, as shown in FIG. 4B. When the pitch conversion is complete, the intervals become the third pitch P3. The wires 2 between the movable wire guide 16 of the first press-contacting portion 8 and the pitch converting comb blade 24 are arranged such that the intervals between the wires increase from the first pitch P1 to a third pitch P3. At this time, it is important that the third pitch P3 is set in advance such that the intervals between the wires 2 in the region of the second press-contacting portion 26 for press-contacting the second connector 20 is equal to a second pitch P2 of the second connector 20.

The positional relationship between the first press-contacting portion 8, the second press-contacting portion 26, and the pitch converting comb blade 24 is expressed by the following equation. That is, a positional equation $$P3=d2(P2-P1)/d1+P1$$

is satisfied, wherein, d1 is the distance between, the first press-contacting portion 8 and the second press-contacting portion 26, as shown in FIG. 4B and FIG. 8, d2 is the distance between the first press-contacting portion 8 and the pitch converting comb blade 24, which acts as the pitch conversion mechanism. In addition, P2 is the arrangement pitch of the terminals of the second connector 20 of the second press-contacting portion 26. In the illustrated embodiment, the distances d1 and d2 from the first press-contacting portion 8 is the distance from the downstream edge of the movable wire guide 16. In embodiments wherein the movable wire guide 16 is not utilized, the center of the first press-contacting portion 8 in the direction of the wire path becomes the starting point of the distance.

After the wires 2 have been arranged by the pitch converting comb blade 24 in the manner as shown in FIG. 4B, the applicator 32 of the second press-contacting portion 26 is inserted into the wires 2 from a location above the wires. At this time, the wires 2 are guided and inserted into slots 34 which are arranged to align with terminals (not shown) of the second connector 20 held by the applicator 32. The method by which the wires 2 are guided and positioned by the applicator 32 will be described with reference to FIGS. 9A–9D.

Figure 5A:
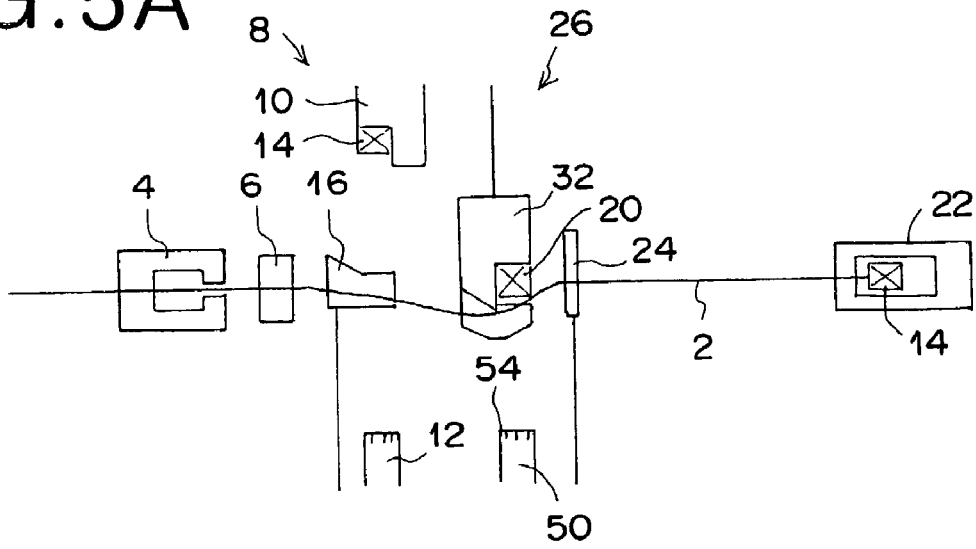
FIG. 5A is a schematic view of the wire insulation displacement connection apparatus showing a second applicator that holds a second connector inserted into the wires.
Figure 9A:
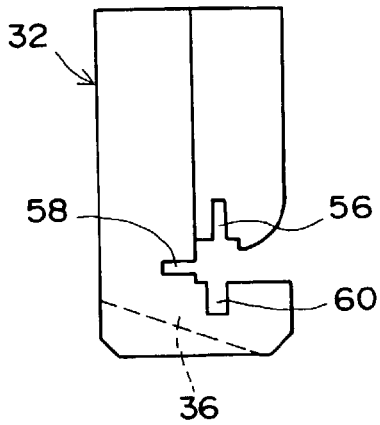
Figure 9B:
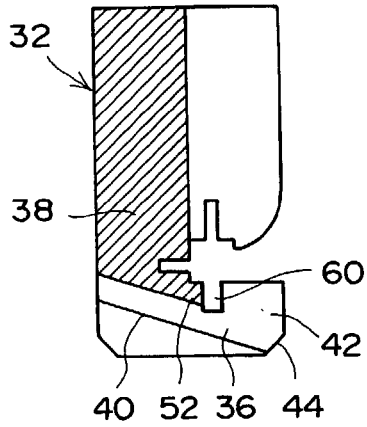
Figure 9C:
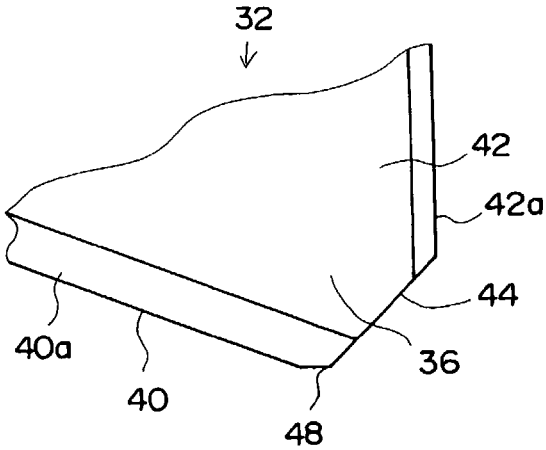
Figure 9D:
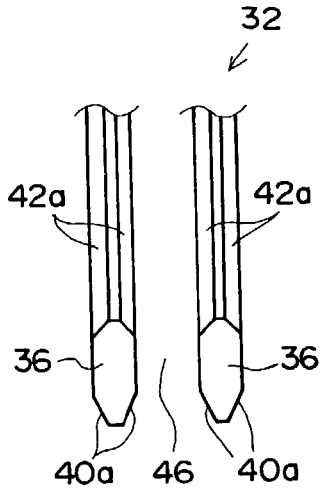

As shown in FIG. 9A, a plurality of comb blades 36 for arranging the wires onto the terminals of the second connector 20 are arranged at the tip of the applicator 32. Each comb blade 36 is provided as a plate that extends downward from a base 38 of the applicator 32, and has a front edge 40 that inclines downward towards the downstream side, and a tongue piece 42 integrally formed thereon. During the press-contact procedure, the stuffer 50 (see FIG. 5A) passes between adjacent tongue pieces 42. Bevels 40*a* and 42*a* are formed on both sides of the edges of the tongue pieces 42, as shown in FIG. 9C. In addition, inclined surfaces 44 are formed at the corners of the tongue pieces 42.

When the applicator 32 descends to be inserted into the wires 2, the bevels 40*a* and 42*a* guide the wires 2 smoothly into slots 46 of adjacent comb blades 36. Further, sharp tips 48 formed by the inclined front edges 40 and the inclined surfaces 44 are formed on the wider side of the arrangement pitch of the wires 2, thereby reducing the possibility of interference with the wires 2 when receiving the wires 2. These bevels 40*a*, 42*a*, the front edge 40 and the inclined surface 44 are collectively referred to as a taper. Cutouts 56 and 58 are provided to avoid interference of tines (not shown) of the terminals (not shown) of the second connector 20. In addition, cutouts 60 are provided such that a shearing blade can be formed on the applicator 32.

Figure 5B:
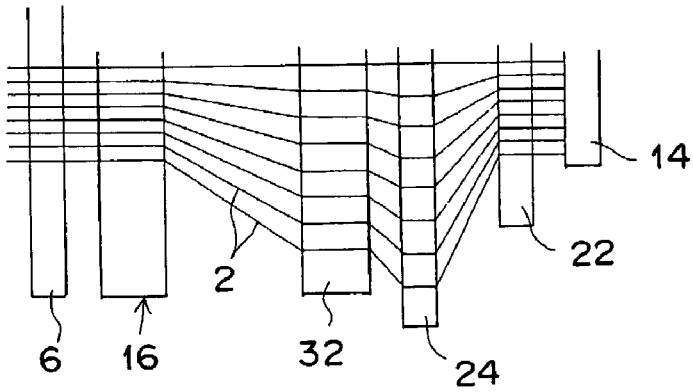
FIG. 5B is a schematic plan view of the wire insulation displacement connection apparatus when the second applicator which holds the second connector is inserted into the wires.

Referring back to FIGS. 5A and 5B, when the wires 2 are arranged to align with the terminals of the second connector 20 as shown in FIG. 5A, the wires 2 are arranged parallel within the slots 46 of the applicator 32, and the wires 2 are accurately press-contacted onto the terminals of the second connector 20. Unlike conventional designs, there is no wire-arranging member for the applicator 32 between the movable wire guide 16 and the applicator 32. Therefore, the wires 2 extending from the movable wire guide 16 are not pulled at a sharp angle. Accordingly, the insulative coating, that is, the outer coating, of the wires 2 is prevented from being damaged at the downstream exit of the movable wire guide 16.

Figure 6:
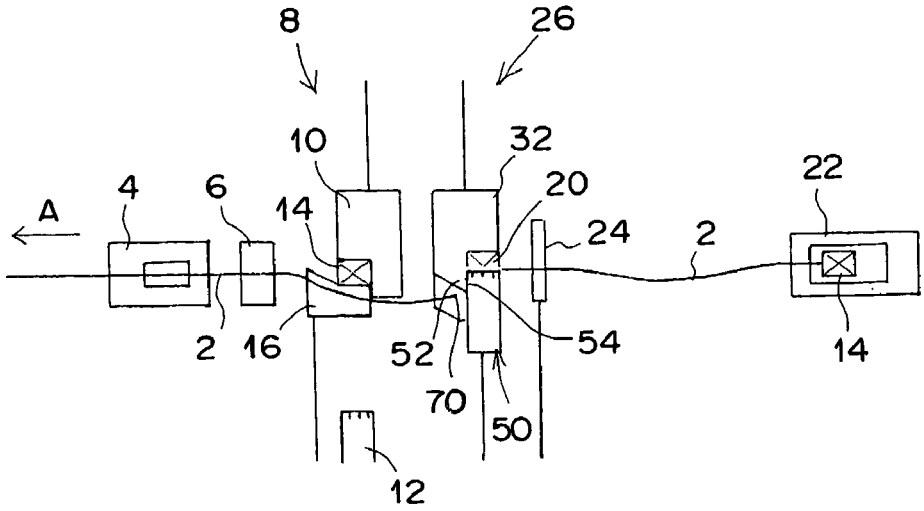
FIG. 6 is a schematic view of the wire insulation displacement connection apparatus showing the wires press-contacted to the second connector by a stuffer.

As shown in FIG. 6, the stuffer 50 approaches the applicator 32 from a location below the wires 2, and press-contacts the wires 2 onto the second connector 20. At this time, the wires 2 are cut by the cooperation of a shearing blade 52 of the applicator 32 and a shearing edge 54 of the stuffer 50. In this manner, a wire harness which has two connectors 14 and 20 press-contacted to the ends of the wires 2 is completed. A wire harness expelling apparatus (not shown) expels the wire harness.

Figure 7:
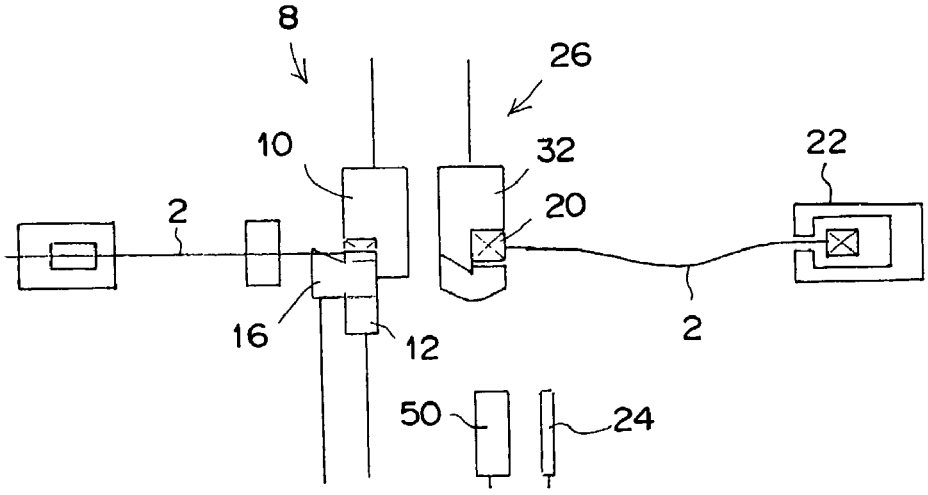
FIG. 7 is a schematic view of the wire insulation displacement connection apparatus showing the wires press-contacted to a subsequent first connector.

To continue the manufacture of wire harnesses, the applicator 10 of the first press-contacting portion 8, on which is mounted a first connector 14 for the subsequent wire harness, is lowered, and the wires 2 guided by the movable wire guide 16 are arranged to align with terminals (not shown) of the first connector 14. Thereafter, the pullback clamp 4 moves in the upstream direction indicated by the arrow A in FIG. 6, to pull back the ends 70 of the wires 2 to the position shown in FIG. 7. When the ends 70 of the wires 2 are situated at the first connector 14, the stuffer 12 approaches the applicator 10 from a location below the wires 2 such that the wires 2 are press-contacted onto the first connector 14, which is held by the applicator 10, as shown in FIG. 7. When the applicator 10, the movable wire guide 16, and the stuffer 12 return to their original positions, the press-contacting apparatus returns to the state shown in FIG. 1. By repeating the processes described above, wire harnesses which have two connectors 14 and 20 press-contacted to the ends of the wires 2 are manufactured.

In the embodiment described above, the pitch of the wires 2 was increased by the pitch converting comb blade 24. However, it is also possible to use a pitch converting comb blade that decreases the pitch of the wires 2, thereby making the second pitch P2 smaller than the first pitch P1.

What is claimed is:

1. A wire insulation displacement connection apparatus with a pitch conversion mechanism, comprising:

a wire supply portion for supplying a plurality of wires;

a first press-contacting portion for press-contacting front tips of the wires to a first connector when said wires are at a first pitch;

a clamp for grasping said first connector or the wires in a vicinity of said first connector and pulling the wires in a downstream direction;

a second press-contacting portion arranged after said first press-contacting portion in the downstream direction for press-contacting the wires to a second connector when the wires are at a second pitch different from said first pitch;

said pitch conversion mechanism for converting the pitch of the wires to enable the wires to be press-contacted with the second connector in said second press-contacting portion;

said pitch conversion mechanism being arranged after said second press-contacting portion in the downstream direction and converting the pitch of the wires to a third pitch such that said first pitch (P1), said second pitch (P2) and said third pitch (P3) satisfy the equation:

$$P3=d2(P2-P1)/d1+P1$$

wherein d1 is the distance between said first press-contacting portion and said second press-contacting portion, and d2 is the distance between said first press-contacting portion and said pitch conversion mechanism; and wherein said first press-contacting portion includes an applicator for holding the first connector and a stuffer arranged below said applicator such that the wires pass between said applicator and said stuffer, said stuffer including blades for pushing the wires into terminals of the first connector when the first connector is held by said applicator.

2. The wire insulation displacement connection apparatus with a pitch conversion mechanism as defined in claim 1, wherein:

said second press-contacting portion includes an applicator for holding the second connector; and tapers are formed at a tip of said applicator for guiding the wires such that the wires align with terminals of the second connector when the second connector is held by said applicator.

3. The wire insulation displacement connection apparatus with a pitch conversion mechanism as defined in claim 1, wherein said first press-contacting portion includes a wire guide movable into a path of the wires to hold the wires at said first pitch.

4. The wire insulation displacement connection apparatus with a pitch conversion mechanism as defined in claim 3, wherein d1 is the distance between a downstream edge of said wire guide and said second press-contacting portion, and d2 is the distance between said downstream edge of said wire guide and said pitch conversion mechanism.

5. The wire insulation displacement connection apparatus with a pitch conversion mechanism as defined in claim 1, wherein said clamp is arranged to grasp the wires in the vicinity of the first connector and pull the wires press-contacted to the first connector in the downstream direction beyond said second press-containing portion and said pitch conversion mechanism.

6. The wire insulation displacement connection apparatus with a pitch conversion mechanism as defined in claim 1, wherein said pitch conversion mechanism is arranged such that said third pitch is larger than said first pitch and thus said second pitch is larger than said first pitch.

7. A wire insulation displacement connection apparatus with a pitch conversion mechanism, comprising:

a wire supply portion for supplying a plurality of wires;

a first press-contacting portion for press-contacting front tips of the wires to a first connector when said wires are at a first pitch;

a clamp for grasping said first connector or the wires in a vicinity of said first connector and pulling the wires in a downstream direction;

a second press-contacting portion arranged after said first press-contacting portion in the downstream direction for press-contacting the wires to a second connector when the wires are at a second pitch different from said first pitch;

said pitch conversion mechanism for converting the pitch of the wires to enable the wires to be press-contacted with the second connector in said second press-contacting portion;

said pitch conversion mechanism being arranged after said second press-contacting portion in the downstream direction and converting the pitch of the wires to a third pitch such that said first pitch (P1), said second pitch (P2) and said third pitch (P3) satisfy the equation:

$$P3=d2(P2-P1)/d1+P1$$

wherein d1 is the distance between said first press-contacting portion and said second press-contacting portion, and d2 is the distance between said first press-contacting portion and said pitch conversion mechanism;

wherein said first press-contacting portion includes a wire guide movable into a path of the wires to hold the wires at said first pitch; and wherein said first press-contacting portion further includes an applicator for holding the first connector and a stuffer arranged below said applicator such that the wires pass between said applicator and said stuffer, said wire guide being arranged below said applicator, said wire guide including grooves and said stuffer including blades insertable within said grooves of said wire guide for pushing the wires into terminals of the first connector when the first connector is held by said applicator.

8. The wire insulation displacement connection apparatus with a pitch conversion mechanism as defined in claim 7, wherein:

said second press-contacting portion includes an applicator for holding the second connector; and tapers are formed at a tip of said applicator for guiding the wires such that the wires align with terminals of the second connector when the second connector is held by said applicator.

9. The wire insulation displacement connection apparatus with a pitch conversion mechanism as defined in claim 7, wherein said clamp is arranged to grasp the wires in the vicinity of the first connector and pull the wires press-contacted to the first connector in the downstream direction beyond said second press-containing portion and said pitch conversion mechanism.

10. The wire insulation displacement connection apparatus with a pitch conversion mechanism as defined in claim 7, wherein said pitch conversion mechanism is arranged such that said third pitch is larger than said first pitch and thus said second pitch is larger than said first pitch.

11. A wire insulation displacement connection apparatus with a pitch conversion mechanism, comprising:

a wire supply portion for supplying a plurality of wires;

a first press-contacting portion for press-contacting front tips of the wires to a first connector when said wires are at a first pitch;

a clamp for grasping said first connector or the wires in a vicinity of said first connector and pulling the wires in a downstream direction;

a second press-contacting portion arranged after said first press-contacting portion in the downstream direction for press-contacting the wires to a second connector when the wires are at a second pitch different from said first pitch;

said pitch conversion mechanism for converting the pitch of the wires to enable the wires to be press-contacted with the second connector in said second press-contacting portion;

said pitch conversion mechanism being arranged after said second press-contacting portion in the downstream direction and converting the pitch of the wires to a third pitch such that first pitch (P1), said second pitch (P2) and said third pitch (P3) satisfy the equation:

$$P3=d2(P2-P1)/d1+P1$$

wherein d1 is the distance between said first press-contacting portion and said second press-contacting portion and d2 is the distance between said first press-contacting portion and said pitch conversion mechanism; and wherein said clamp is arranged to grasp the first connector and pull the first connector with the wires press-contacted thereto in the downstream direction beyond said second press-containing portion and said pitch conversion mechanism.

12. The wire insulation displacement connection apparatus with a pitch conversion mechanism as defined in claim 11, wherein:

said second press-contacting portion includes an applicator for holding the second connector; and tapers are formed at a tip of said applicator for guiding the wires such that the wires align with terminals of the second connector when the second connector is held by said applicator.

13. The wire insulation displacement connection apparatus with a pitch conversion mechanism as defined in claim 11, wherein said first press-contacting portion includes a wire guide movable into a path of the wires to hold the wires at said first pitch.

14. The wire insulation displacement connection apparatus with a pitch conversion mechanism as defined in claim 11, wherein said clamp is arranged to grasp the wires in the vicinity of the first connector and pull the wires press-contacted to the first connector in the downstream direction beyond said second press-containing portion and said pitch conversion mechanism.

15. The wire insulation displacement connection apparatus with a pitch conversion mechanism as defined in claim 11, wherein said pitch conversion mechanism is arranged such that said third pitch is larger than said first pitch and thus said second pitch is larger than said first pitch.

16. A wire insulation displacement connection apparatus with a pitch conversion mechanism, comprising:

a wire supply portion for supplying a plurality of wires;

a first press-contacting portion for press-contacting front tips of the wires to a first connector when said wires are at a first pitch;

a clamp for grasping said first connector or the wires in a vicinity of said first connector and pulling the wires in a downstream direction;

a second press-contacting portion arranged after said first press-contacting portion in the downstream direction for press-contacting the wires to a second connector when the wires are at a second pitch different from said first pitch;

said pitch conversion mechanism for converting the pitch of the wires to enable the wires to be press-contacted with the second connector in said second press-contacting portion;

said pitch conversion mechanism being arranged after said second press-contacting portion in the downstream direction and converting the pitch of the wires to a third pitch such that said first pitch (P1), said second pitch (P2) and said third pitch (P3) satisfy the equation:

$$P3=d2(P2-P1)/d1+P1$$

wherein d1 is the distance between said first press-contacting portion and said second press-contacting portion, and d2 is the distance between said first press-contacting portion and said pitch conversion mechanism; and wherein said pitch conversion mechanism comprises a comb blade including a plurality of grooves extending from openings arranged at said first pitch at an upper edge of said comb blade to an interior of said comb blade at which said grooves are at said third pitch.

17. The wire insulation displacement connection apparatus with a pitch conversion mechanism as defined in claim 16, wherein at least some of said grooves in said comb blade extend outward.

18. The wire insulation displacement connection apparatus with a pitch conversion mechanism as defined in claim 16, wherein:

said second press-contacting portion includes an applicator for holding the second connector; and tapers are formed at a tip of said applicator for guiding the wires such that the wires align with terminals of the second connector when the second connector is held by said applicator.

19. The wire insulation displacement connection apparatus with a pitch conversion mechanism as defined in claim 16, wherein said first press-contacting portion includes a wire guide movable into a path of the wires to hold the wires at said first pitch.

20. The wire insulation displacement connection apparatus with a pitch conversion mechanism as defined in claim 16, wherein said clamp is arranged to grasp the wires in the vicinity of the first connector and pull the wires press-contacted to the first connector in the downstream direction beyond said second press-containing portion and said pitch conversion mechanism.

21. The wire insulation displacement connection apparatus with a pitch conversion mechanism as defined in claim 16, wherein said pitch conversion mechanism is arranged such that said third pitch is larger than said first pitch and thus said second pitch is larger than said first pitch.

* * * * *